United States Patent [19]

Sandberg et al.

[11] Patent Number: 4,596,996

[45] Date of Patent: Jun. 24, 1986

[54] PRESSURE-SENSITIVE RECORDING SHEET

[75] Inventors: Robert W. Sandberg; Bruce W. Brockett; Kristi A. Blythe, all of Appleton, Wis.

[73] Assignee: Appleton Papers Inc., Appleton, Wis.

[21] Appl. No.: 700,583

[22] Filed: Feb. 11, 1985

[51] Int. Cl.[4] ..... B41M 5/22

[52] U.S. Cl. ..... 346/207; 346/213; 346/214; 346/215; 428/212

[58] Field of Search ..... 346/200, 213, 215, 226, 346/207, 214, 218; 428/212

[56] References Cited

U.S. PATENT DOCUMENTS 3,955,025 5/1976 Matsukawa et al. ..... 346/226
3,955,026 5/1976 Matsukawa et al. ..... 346/226

FOREIGN PATENT DOCUMENTS 2000464 12/1970 Fed. Rep. of Germany ..... 346/226

*Primary Examiner*—Bruce H. Hess
*Attorney, Agent, or Firm*—E. Frank McKinney; Paul S. Phillips, Jr.

[57] ABSTRACT

Disclosed is a pressure-sensitive recording material which comprises a support having thereon a two-layer microcapsule coating wherein the microcapsule layer adjacent to the support contains no color former. Such recording material makes possible a substantial decrease in quantity of color former required.

20 Claims, No Drawings

PRESSURE-SENSITIVE RECORDING SHEET

This invention relates to a novel pressure-sensitive recording sheet and, more particularly, it relates to a pressure-sensitive recording sheet having an improved color former layer.

Pressure-sensitive carbonless copy paper of the transfer type consists of multiple cooperating superimposed plies in the form of sheets of paper which have coated, on one surface of one such ply, pressure-rupturable microcapsules containing a solution of one or more color formers (hereinafter referred to as a CB sheet) for transfer to a second ply carrying a coating comprising one or more color developers (hereinafter referred to as a CF sheet). To the uncoated side of the CF sheet can also be applied pressure-rupturable microcapsules containing a solution of color formers resulting in a pressure-sensitive sheet which is coated on both the front and back sides (hereinafter referred to as a CFB sheet). When said plies are superimposed, one on the other, in such manner that the microcapsules of one ply are in proximity with the color developers of the second ply, the application of pressure, as by typewriter, sufficient to rupture the microcapsules, releases the solution of color former (also called chromogenic material) and transfers color former solution to the CF sheet resulting in image formation through reaction of the color former solution with the color developer. Such transfer systems and their preparation are disclosed in U.S. Pat. No. 2,730,456.

A CB sheet traditionally consists of a substrate or base sheet coated with a color former layer consisting of a mixture of pressure-rupturable microcapsules, protective stilt material such as uncooked starch particles and one or more binder materials. The color formers, compared to the other components of the color former layer, are extremely costly and, therefore, maximizing the utilization of these color formers in the production of images is a continuing objective of pressure-sensitive carbonless copy paper manufacturers.

Various methods to more efficiently utilize the color former solution of the CB sheet have been disclosed. U.S. Pat. No. 3,565,666 discloses the use of a subcoating of latex material to assist in the transfer of capsule-yielded liquid from the ruptured capsules to the CF sheet during the application of imaging printing pressures.

U.S. Pat. No. 3,955,025 discloses a CB sheet consisting of a support having two color former-containing microcapsule layers with the mean particle size of the microcapsules in the second microcapsule layer being smaller than the mean particle size in the first microcapsule layer.

U.S. Pat. No. 3,955,026 discloses a CB sheet consisting of a support having two color former-containing microcapsule layers with the color former concentration in the second microcapsule layer being lower than the color former concentration in the first microcapsule layer.

Both of U.S. Pat. Nos. 3,955,025 and 3,955,026 specifically exclude from the invention disclosed therein and teach away from a CB sheet comprising a support having two microcapsule layers wherein the microcapsule layer adjacent to the support contains no color former.

It is therefore an object of the present invention to provide a pressure-sensitive recording sheet having enhanced utilization of the color former solution.

Another object of the present invention is to provide a pressure-sensitive recording sheet which produces transfer images of acceptable intensity from reduced quantities of color former.

A further object of the present invention is to provide a pressure-sensitive recording sheet which produces enhanced transfer image intensities from conventional quantities of color former.

Still another object of the present invention is to provide a pressure-sensitive recording sheet which produces enhanced transfer image intensities from reduced quantities of color former.

Yet another object of the present invention is to provide a pressure-sensitive recording sheet comprising a support having bound on the surface thereof a two-layer microcapsule coating, wherein the microcapsule layer adjacent to the support contains no color former.

In accordance with the present invention, it has been found that these and other objectives may be attained by employing a CB sheet which comprises a base coat comprising microcapsules which contain liquid core material, but no color former, and a topcoat comprising microcapsules which contain a liquid color former solution. The surprising feature of this invention is that at least normally acceptable image intensities can be obtained from CB sheets containing less color former per unit area or, conversely, enhanced image intensities can be obtained from CB sheets containing normal amounts of color former per unit area.

This invention is equally useful for the CB coating of CFB sheets. Therefore, the two layer microcapsule coating of the pressure-sensitive recording material of the present invention includes both CB and CFB sheets.

Although any binder material, known in the art for preparing microcapsular coatings, may be employed with either the base coat or the top coat, the results are even further improved when a latex binder is used in the base coat.

The liquid core material empolyed in the microcapsules of the base coat can be any material which is liquid within the temperature range at which carbonless copy paper is normally used and which does not suppress or otherwise adversely affect the color-forming reaction. Examples of eligible liquids include, but are not limited to, those solvents conventionally used for carbonless copy paper, including ethyldiphenylmethane (U.S. Pat. No. 3,996,405); benzylxylene (U.S. Pat. No. 4,130,299); alkyl biphenyls such as propylbiphenyl (U.S. Pat. No. 3,627,581) and butylbiphenyl (U.S. Pat. No. 4,287,074); dialkyl phthalates in which the alkyl groups thereof have from 4 to 13 carbon atoms, e.g. dibutyl phthalate, dioctylphthalate, dinonyl phthalate and ditridecylphthalate; 2,2,4-trimethyl-1,3-pentanediol diisobutyrate (U.S. Pat. No. 4,027,065); $C_{10}$–$C_{14}$ alkyl benzenes such as dodecyl benzene; alkyl or aralkyl benzoates such as benzyl benzoate; alkylated naphthalenes such as dipropylnaphthalene (U.S. Pat. No. 3,806,463); partially hydrogenated terphenyls; high-boiling straight or branched chain hydrocarbons; and mixtures of the above. The solvents for the color former solution can include any of the above which possess sufficient solubility for the color former.

The microcapsules for either layer can be prepared by processes well known in the art such as from gelatin as disclosed in U.S. Pat. Nos. 2,800,457 and 3,041,289; or, more preferably, from urea-formaldehyde resin and/or melamine-formaldehyde resin as disclosed in U.S.

Pat. Nos. 4,001,140; 4,081,376; 4,089,802, 4,100,103; 4,105,823 or 4,444,699.

Although this invention can be demonstrated with any size of microcapsule normally used for CB coatings, the results are even further improved when the mean particle size of the base coat microcapsules is less than the mean particle size of the top coat microcapsules.

The CB sheet of the present invention can be utilized for image formation with any CF sheet which contains one or more developer materials for the color former material employed in the CB sheet.

When the color former employed in the CB sheet of the present invention is a basic chromogenic material, then any known acidic developer material may be employed in the CF sheet, such as, for example, clays; treated clays (U.S. Pat. Nos. 3,622,364 and 3,753,761); aromatic carboxylic acids such as salicylic acid; derivatives of aromatic carboxylic acids and metal salts thereof (U.S. Pat. No. 4,022,936); phenolic developers (U.S. Pat. No. 3,244,550); acidic polymeric material such as phenol-formaldehyde polymers, etc. (U.S. Pat. Nos. 3,455,721 and 3,672,935); and metal-modified phenolic resins (U.S. Pat. Nos. 3,732,120; 3,737,410; 4,165,102; 4,165,103; 4,166,644 and 4,188,456).

The following examples are given merely as illustrative of the present invention and are not to be considered as limiting. All percentages and parts throughout the application are by weight unless otherwise specified.

Color-former solutions were prepared according to the materials and relative amounts listed in Tables 1 and 2.

TABLE 1

| Material | Parts |
|---|---|
| 3,3-bis(p-dimethylaminophenyl)-6-dimethylaminophthalide (Crystal Violet Lactone) | 1.70 |
| 3,3-bis(1-ethyl-2-methylindol-3-yl)phthalide | 0.55 |
| 2'-anilino-3'-methyl-6'-diethylaminofluoran (U.S. Pat. No. 3,746,562) | 0.55 |
| benzylated xylenes (U.S. Pat. No. 4,130,299) | 34.02 |
| $C_{10}$–$C_{13}$ alkylbenzene | 34.02 |
| $C_{11}$–$C_{15}$ aliphatic hydrocarbon | 29.16 |

TABLE 2

| Material | Parts |
|---|---|
| 2'anilino-6'-diethylamino-3'-methylfluoran (U.S. Pat. No. 3,746,562) | 4.00 |
| 7-(1-ethyl-2-methylindol-3-yl)-7-(4-diethylamino-2-ethoxyphenyl)-5,7-dihydrofuro[3,4-b]pyridin-5-one (U.S. Pat. No. 4,275,905) | 0.50 |
| 3,3-bis(1-ethyl-2-methylindol-3-yl)phthalide | 0.12 |
| 3-cyclohexylamino-6-chlorofluoran | 0.12 |
| butylbiphenyl (U.S. Pat. No. 4,287,074) | 80.97 |
| $C_{11}$–$C_{15}$ aliphatic hydrocarbon | 14.29 |

The color-former solution of Table 1 was microencapsulated according to the procedure of U.S. Pat. No. 4,001,140, producing what will be referred to as the color-former 1 capsules or C-F 1 capsules.

The color-former solution of Table 2 was microencapsulated according to the procedure of U.S. Pat. No. 4,100,103, producing what will be referred to as the color-former 2 capsules or C-F 2 capsules.

For the microcapsules to be employed in one of the base coats, a $C_{11}$–$C_{15}$ aliphatic hydrocarbon was microencapsulated according to the procedure of U.S. Pat. No. 4,100,103. This will be referred to as base coat 1 capsules or B-C 1 capsules.

For the microcapsules to be employed in another of the base coats, a $C_{10}$–$C_{13}$ alkylbenzene was microencapsulated according to the procedure of U.S. Pat. No. 4,100,103. This will be referred to as base coat 2 capsules or B-C 2 capsules.

The resulting base coat microcapsule batches were each mixed with a corn starch binder solution, uncooked wheat starch particles and water to produce 18% solids coating dispersions having the dry composition listed in Table 3.

TABLE 3

| Material | Parts, Dry |
|---|---|
| microcapsules | 40 |
| modified corn starch binder | 4 |
| wheat starch particles | 10 |

This coating dispersion was applied to a 50 grams per square meter (gsm) web by means of a wire-wound coating rod and the coating was dried by means of hot air, resulting in a dry coat weight of base coat of about 2.2 gsm.

Each of the color-former capsule batches was mixed with a corn starch binder solution, uncooked wheat starch particles (stilt material) and water to produce 18% solids coating dispersions having the dry composition listed in Table 4.

TABLE 4

| Material | Parts, Dry |
|---|---|
| color-former capsule | 40 |
| corn starch binder | 4 |
| wheat starch particles | 10 |

Each of the coating dispersions, prepared according to Table 4, was applied to a dried base coating by means of a wire-wound coating rod and the resulting coatings were dried by means of hot air. The same coating dispersions were applied to a non-base-coated paper web and dried in the same manner to produce controls.

The resulting CB sheets were coupled with a CF sheet comprising a zinc-modified phenolic resin as disclosed in U.S. Pat. Nos. 3,732,120 and 3,737,410. The couplets were imaged in a Typewriter Intensity (TI) test described as follows:

In the TI test a standard pattern is typed on a CB-CF pair. The reflectance of the typed area is a measure of color development on the CF sheet and is reported as the ratio of the reflectance of the typed area to that of the background reflectance of the CF paper (I/Io), expressed as a percentage.

The print intensity from a TI test expressed in I/Io% terms is useful for demonstrating whether one image is more or less intense than another. However, if it is desired to express print intensity in terms of the quantity of color present in each image, the reflectance ratio, I/Io, must be converted to another form. The Kubelka-Munk function has been found useful for this purpose. Use of the Kubelka-Munk function as a means of determining the quantity of color present is discussed in TAPPI, *Paper Trade J.*, pages 13–38 (Dec. 21, 1939).

Entered in Table 5 are the type of base coat and the type and coat weights (CW) of color former top coat of each example and control. The coat weight of the color former top coat layer represents the weight of the color former microcapsules only and does not include the weight of the starch binder or starch particles. Also entered in Table 5 are the TI data for each example and the control, expressed in I/Io(%) and Kubelka-Munk (K-M) units, and the ratio of the Kubelka-Munk function to the top coat microcapsular coat weight. All data are the average of two determinations for each sample.

TABLE 5

| Example | Base Coat | Color Former Capsule Coating Type | CW, gsm | TI I/Io (%) | K-M | K-M CW |
|---|---|---|---|---|---|---|
| 1 (Control) | none | C-F 1 | 1.95 | 47.7 | .284 | 0.146 |
| 2 | B-C 1 | C-F 1 | 2.07 | 33.7 | .652 | 0.315 |
| 3 (Control) | none | C-F 2 | 1.85 | 50.6 | .241 | 0.130 |
| 4 | B-C 2 | C-F 2 | 1.95 | 36.7 | .546 | 0.280 |

The data of Table 5 clearly demonstrate that the Examples of the invention produce surprisingly more color per unit of available color former than does the control. In both instances more than twice the quantity of color was produced by the examples of the invention after normalizing for differences in color former microcapsule coat weights.

In order to study the factors related to microcapsule rupture and transfer of the contents of ruptured microcapsules during an impact test, the following series of examples was prepared. The difference between the examples to be described and Examples 2 and 4 is that the base coat microcapsules will have a color former present as a means of accurately determining the coat weight. Since the performance of the CB sheets of this invention, as demonstrated by Examples 2 and 4, is directly related to the amount of color former solution transferred from the microcapsules of the top coating, the remainder of the Examples to follow, will be evaluated on the basis of relative efficiencies and amount of transfer of the contents of the microcapsules of the top coat. This type of an analysis is made by colorimetrically determining the amount of color former (and hence the amount of color former solution) present in the CB sheet before and after microcapsule rupture and transfer of microcapsule contents as occurs, for example, in the typewriter imaging test.

A color former solution was prepared according to the materials and relative amounts listed in Table 6.

TABLE 6

| Material | Parts |
|---|---|
| 3,3-bis(p-dimethylaminophenyl)-6-dimethylaminophthalide (Crystal Violet Lactone) | 1.40 |
| 3,3-bis(1-octyl-2-methylindol-3-yl)phthalide | 0.60 |
| 2'-anilino-3'-methyl-6'-diethylaminofluoran (U.S. Pat. No. 3,746,562) | 0.30 |
| 7-(1-ethyl-2-methylindol-3-yl)-7-(4-diethylamino-2-ethoxyphenyl)-5,7-dihydrofuro[3,4-b]pyridin-5-one (U.S. Pat. No. 4,275,905) | 0.50 |
| butylbiphenyl (U.S. Pat. No. 4,287,074) | 34.02 |
| $C_{10}$–$C_{13}$ alkylbenzene | 34.02 |
| $C_{11}$–$C_{15}$ aliphatic hydrocarbon | 29.16 |

The color-former solution of Table 6 was microencapsulated according to the procedure of U.S. Pat. No. 4,100,103, producing what will be referred to as the color-former 3 capsules or C-F 3 capsules.

For the microcapsules to be employed as the base coat for this series, the solution of Table 7 was microencapsulated according to the procedure of U.S. Pat. No. 4,100,103, producing what will be referred to as base coat 3 capsules or B-C 3 capsules.

TABLE 7

| | |
|---|---|
| 3-cyclohexylamino-6-chlorofluoran | 1.00 |
| butylbiphenyl (U.S. Pat. No. 4,287,074) | 19.80 |
| $C_{10}$–$C_{13}$ alkylbenzene | 79.20 |

The B-C 3 capsules batch was formulated in two different ways and each formulation was applied at 20% solids to a 50 gsm paper web by means of an air knife coating station and the coating was dried by means of hot air. The two formulations utilized for the B-C 3 capsules were as follows:

B-C 3a

| Material | Parts, Dry |
|---|---|
| B-C 3 capsules | 90.9 |
| corn starch binder | 9.1 |

B-C 3b

| Material | Parts, Dry |
|---|---|
| B-C 3 capsules | 90.9 |
| latex binder | 9.1 |

The color-former capsules (C-F 3) were mixed with a corn starch binder solution, uncooked wheat starch particles and water to produce a 24% solids coating dispersion having the dry composition listed in Table 8.

TABLE 8

| Material | Parts, Dry |
|---|---|
| color-former capsule (C-F 3) | 100 |
| corn starch binder | 10 |
| wheat starch particles | 20 |

This coating dispersion was applied to each of the dried base coatings (B-C 3a and B-C 3b) by means of an air knife coating station and the resulting coatings were dried by means of hot air. The same coating dispersion was applied to a non-base-coated paper web and dried in the same manner to produce a control.

The coat weight of each layer of each of the resulting CB sheets was determined by specific colorimetric analysis. The CB sheets were then coupled with a CF sheet comprising a zinc-modified phenolic resin as disclosed in U.S. Pat. Nos. 3,732,120 and 3,737,410. The couplets were impacted in a Typewriter Intensity (TI) test. The percentage transfer of the color former solution from the top coat was determined by colorimetric analysis of one or more of the color formers present.

Entered in Table 9 are the type and coat weights (CW) of the microcapsules in the base coat and the type and coat weights of the microcapsules in the top coat of each example and the control. Also entered in Table 9 are the percentage transfer of the capsule contents of the top coat during the TI imaging test.

TABLE 9

| Example | Base Coat Type | Base Coat CW, gms | Top Coat Capsule Type | Top Coat CW, gsm | Transfer from Top Coat |
|---|---|---|---|---|---|
| 5 (control) | none | — | C-F 3 | 3.15 | 26.0% |
| 6 | B-C 3a | 1.54 | C-F 3 | 3.23 | 27.8% |
| 7 | B-C 3a | 1.78 | C-F 3 | 3.32 | 28.4% |

TABLE 9-continued

| Example | Base Coat Type | Base Coat CW, gms | Top Coat Capsule Type | Top Coat CW, gsm | Transfer from Top Coat |
|---|---|---|---|---|---|
| 8 | B-C 3a | 2.75 | C-F 3 | 3.32 | 30.4% |
| 9 | B-C 3b | 2.26 | C-F 3 | 3.42 | 32.4% |

From the data in Table 9, it can be seen that transfer of color former solution from the top coat unexpectedly increases with the use of a microcapsular base coat, increases with increasing coat weight of the base coat and increases further when a latex binder is used in the base coat in place of a corn starch binder.

In the next series of Examples, the size of the microcapsules of the base coat was varied and the effect of this variation on CB transfer characteristics determined.

A color former solution of 2% 7-(1-octyl-2-methylindol-3-yl)-7-(4-diethylamino-2-ethoxyphenyl)-5,7-dihydrofuro[3,4-b]pyridin-5-one in $C_{10}$-$C_{13}$ alkylbenzene was microencapsulated according to the procedure in copending application Ser. No. 619,967, filed June 12, 1984, of Robert W. Brown et al., producing what will be referred to as color-former 4 or C-F 4 capsules.

For the base coat microcapsules, the two different solutions in Table 10 were prepared.

TABLE 10

| Material | Parts, Dry |
|---|---|
| B-C 4 | |
| 3,3-bis(1-octyl-2-methylindol-3-yl)phthalide | 2 |
| $C_{11}$-$C_{15}$ aliphatic hydrocarbon | 98 |
| B-C 5 | |
| 3,3-bis(1-octyl-2-methylindol-3-yl)phthalide | 2 |
| mineral oil | 98 |

Each of the solutions of Table 10 was microencapsulated according to the procedure in copending application Ser. No. 619,967. Each of the solutions was microencapsulated by said procedure in two different batches at two different mean capsule sizes (by volume).

Each of the four above-referenced base coat microcapsule batches was mixed with a latex binder according to the formulation listed in Table 11, producing an 18% solids coating mixture which was applied to a 50 gsm paper substrate by means of a wire-wound coating rod and the coating was dried with hot air.

TABLE 11

| Material | Parts, Dry |
|---|---|
| microcapsules | 100 |
| latex binder | 10 |

The color-former capsules (C-F 4) were mixed with a binder material, uncooked wheat starch particles and water to produce an 18% solids coating dispersion having the dry composition listed in Table 12.

TABLE 12

| Material | Parts, Dry |
|---|---|
| C-F 4a | |
| color-former capsule | 100 |
| corn starch binder | 8 |
| wheat starch particles | 26 |
| C-F 4b | |
| color-former capsule | 100 |
| latex binder | 8 |
| wheat starch particles | 26 |

Each of these coating dispersions was applied to each of the dried base coatings by means of a wire wound coating rod and the resulting top coatings were dried by means of hot air. The same coating dispersions were applied to an non-base-coated paper web and dried in the same manner to produce controls.

The resulting CB sheets were coupled with a CF sheet comprising a zinc-modified phenolic resin as disclosed in U.S. Pat. Nos. 3,732,120 and 3,737,410. The couplets were impacted in a Typewriter Intensity (TI) test.

Entered in Table 13 are the type, mean capsule size in microns and coat weight (CW) of the base coat microcapsules and the type and coat weight of the top coat microcapsules of each example and control. Also entered in Table 13 are the top coat transfer data for each example and control.

TABLE 13

| Example | Base Coat Type | Base Coat Capsule Size | Base Coat Capsule CW, gsm | Top Coat Type | Top Coat Capsule CW, gsm | Transfer from Top Coat |
|---|---|---|---|---|---|---|
| 10 (control) | none | — | — | C-F 4b | 2.66 | 27.2% |
| 11 | B-C 4 | 5.7 | 2.29 | C-F 4b | 2.71 | 36.2% |
| 12 | B-C 4 | 2.8 | 2.29 | C-F 4b | 2.63 | 42.0% |
| 13 | B-C 5 | 6.5 | 2.77 | C-F 4b | 2.68 | 36.4% |
| 14 | B-C 5 | 2.6 | 2.81 | C-F 4b | 2.62 | 43.0% |
| 15 (control) | none | — | — | C-F 4a | 2.43 | 28.1% |
| 16 | B-C 4 | 5.7 | 2.37 | C-F 4a | 3.00 | 36.0% |
| 17 | B-C 4 | 2.8 | 2.37 | C-F 4a | 2.84 | 42.5% |
| 18 | B-C 5 | 6.5 | 3.09 | C-F 4a | 2.84 | 37.2% |
| 19 | B-C 5 | 2.6 | 2.77 | C-F 4a | 2.81 | 42.5% |

From the data in Table 13, it can be seen that transfer of color former solution from the top coat unexpectedly increases when the size of the microcapsules in the base coat is decreased.

The invention being thus described, it will be obvious that the same may be varied in many ways. Such variations are not to be regarded as a departure from the spirit and scope of the invention and all such modifications are intended to be included within the scope of the following claims.

What is claimed is:

1. A pressure-sensitive recording material comprising a support having bound on the surface thereof a two layer microcapsule coating, wherein the microcapsules in the layer adjacent to the support contain liquid core material but no color former and the microcapsules in the other layer contain a liquid color former solution.

2. The recording material of claim 1, wherein the color former of the microcapsule layer containing same is a basic chromogenic material.

3. The recording material of claim 2 wherein the layer containing the color former solution further comprises a particulate starch material.

4. The recording material of claim 3 wherein the microcapsule layer adjacent to the support is bound by means of a latex binder.

5. The recording material of claim 1 or 3 wherein the support is paper.

6. The recording material of claim 5 wherein the mean particle size of the microcapsules in the layer adjacent to the support is less than the mean particle size of the microcapsules in the other layer.

7. The recording meaterial of claim 6 wherein the microcapsule in the layer adjacent to the support contains an aliphatic hydrocarbon.

8. A pressure-sensitive recording material comprising a support having bound on the surface thereof a first composition comprising microcapsules containing liquid core material but no color former, and a second composition comprising microcapsules containing a liquid color former solution bound on the surface of the first composition.

9. The recording material of claim 8, wherein the color former is a basic chromogenic material.

10. The recording material of claim 9, wherein the second composition further comprises a particulate starch material.

11. The recording material of claim 10, wherein the first composition is bound by means of a latex binder.

12. The recording material of claim 8 or 10 wherein the support is paper.

13. The recording material of claim 12 wherein the mean particle size of the microcapsules in the first composition is less than the mean particle size of the microcapsules in the second composition.

14. The recording material of claim 13 wherein the microcapsule in the first composition contains an aliphatic hydrocarbon.

15. A pressure-sensitive recording material comprising a support having bound on the surface thereof a first composition comprising microcapsules containing liquid core material, but no color former, and a binder material, and a second composition comprising microcapsules containing a liquid, basic chromogenic color former solution, a binder material and a stilt material bound on the surface of the first composition.

16. The recording material of claim 15, wherein the stilt material is a particulate starch material.

17. The recording material of claim 16, wherein the binder material of the first composition is a latex.

18. The recording material of claim 15 or 16 wherein the support is paper.

19. The recording material of claim 18 wherein the mean particle size of the microcapsules in the first composition is less than the mean particle size of the microcapsules in the second composition.

20. The recording material of claim 18 wherein the microcapsule in the first composition contains an aliphatic hydrocarbon.

* * * * *